US007146659B2

(12) United States Patent
Mattson, Jr. et al.

(10) Patent No.: US 7,146,659 B2
(45) **Date of Patent: *Dec. 12, 2006**

(54) HYDROMASSAGE ANTIMICROBIAL WHIRLPOOL BATHTUB

(76) Inventors: Roy W. Mattson, Jr., 1732 Spencer St., Longmont, CO (US) 80501; Paulette C. Ogden, 1732 Spencer St., Longmont, CO (US) 80501; Philip I. Ogden, 1732 Spencer St., Longmont, CO (US) 80501

( * ) Notice: Subject to any disclaimer, the term of this patent is extended or adjusted under 35 U.S.C. 154(b) by 18 days.

This patent is subject to a terminal disclaimer.

(21) Appl. No.: 11/207,140

(22) Filed: Aug. 18, 2005

(65) Prior Publication Data

US 2005/0273921 A1 Dec. 15, 2005

Related U.S. Application Data

(60) Continuation-in-part of application No. 11/114,844, filed on Apr. 26, 2005, now Pat. No. 6,971,125, which is a continuation of application No. 10/841,925, filed on May 7, 2004, now abandoned, which is a division of application No. 10/211,497, filed on Aug. 2, 2002, now Pat. No. 6,760,931.

(51) Int. Cl.
*A47K 3/00* (2006.01)
*A47K 3/01* (2006.01)

(52) U.S. Cl. ..... 4/541.1; 4/507; 4/509; 210/109

(58) Field of Classification Search ..... 4/490, 4/504, 506, 507, 541.1, 541.2, 541.3, 538, 4/584; 210/109
See application file for complete search history.

(56) References Cited

U.S. PATENT DOCUMENTS

| | | | |
|---|---|---|---|
| 148,288 | A | 3/1874 | Edgar |
| 206,938 | A | 8/1878 | Emory |
| 553,383 | A | 1/1896 | Bailey |
| 828,716 | A | 8/1906 | Craig |
| 1,284,615 | A | 11/1918 | Delely |
| 1,428,618 | A | 9/1922 | Wagner |
| 1,594,400 | A | 8/1926 | Wiest |
| 2,073,784 | A | 3/1937 | Day |
| 2,194,056 | A | 3/1940 | Quagk |
| 2,204,898 | A | 6/1940 | Lee |
| 2,247,116 | A | 6/1941 | Day |

(Continued)

FOREIGN PATENT DOCUMENTS

DE 199 61049 A1 6/2001

(Continued)

OTHER PUBLICATIONS

Relaxing in Filth: What your Hottub May be Hiding By: Kelli M. Donley.

(Continued)

*Primary Examiner*—Tuan Nguyen
(74) *Attorney, Agent, or Firm*—Faegre & Benson LLP

(57) ABSTRACT

A fill and drain jetted hydromassage whirlpool bathtub having a tub made of acrylic, resin and fiberglass. The whirlpool bathtub having a water system with drain down water features and components made of a material having an antimicrobial therein. Bacteria reduction occurs in the water vessel system where the antimicrobial is therein. The non-porous acrylic surface, the drain down features and the antimicrobial surfaces provide an economic sanitation level for hydromassage jetted whirlpool bathtub.

15 Claims, 8 Drawing Sheets

U.S. PATENT DOCUMENTS

| | | | |
|---|---|---|---|
| 2,329,987 | A | 9/1943 | Goodloe |
| 2,367,794 | A | 1/1945 | Marselus |
| 2,552,709 | A | 5/1951 | Clements |
| 2,709,489 | A | 5/1955 | Keebler |
| 3,027,391 | A | 3/1962 | Selri |
| 3,198,726 | A | 8/1965 | Triklis |
| 3,263,811 | A | 8/1966 | Bakes et al. |
| 3,294,680 | A | 12/1966 | Lancy |
| 3,385,445 | A | 5/1968 | Bochegger et al. |
| 3,422,183 | A | 1/1969 | Ellison |
| 3,426,901 | A | 2/1969 | Sharper |
| 3,575,853 | A | 4/1971 | Gaughan |
| 3,615,294 | A | 10/1971 | Long |
| 3,697,567 | A | 10/1972 | Taylor, Jr. |
| 3,702,298 | A | 11/1972 | Solaos, Jr. et al. |
| 3,726,540 | A | 4/1973 | Wimmer |
| 3,768,036 | A | 10/1973 | McKartney |
| 3,788,982 | A | 1/1974 | Soldos |
| 3,802,910 | A | 4/1974 | Geron |
| 3,839,202 | A | 10/1974 | Roy |
| 3,857,704 | A | 12/1974 | Coulter |
| 3,873,581 | A | 3/1975 | Fitzpatrick |
| 3,905,827 | A | 9/1975 | Goffredo |
| 3,922,224 | A | 11/1975 | Lewandowski |
| 3,933,635 | A | 1/1976 | Marchant |
| 3,976,571 | A | 8/1976 | Rio |
| 3,989,623 | A | 11/1976 | Neal |
| 4,005,011 | A | 1/1977 | Sweeny |
| 4,026,797 | A | 5/1977 | Nikolic |
| 4,028,236 | A | 6/1977 | Townsend |
| 4,052,318 | A | 10/1977 | Krebs |
| 4,053,403 | A | 10/1977 | Bachhofer et al. |
| 4,078,040 | A | 3/1978 | Milkov |
| 4,094,777 | A | 6/1978 | Sugier |
| 4,108,770 | A | 8/1978 | Roy |
| 4,180,473 | A | 12/1979 | Maurer et al. |
| D254,870 | S | 4/1980 | Ogden |
| 4,219,419 | A | 8/1980 | Sweeny |
| 4,233,694 | A | 11/1980 | Janosko et al. |
| 4,241,025 | A | 12/1980 | Grayson et al. |
| 4,257,893 | A | 3/1981 | Burton |
| 4,303,441 | A | 12/1981 | Lamisse |
| 4,309,992 | A | 1/1982 | Dodak et al. |
| 4,337,136 | A | 6/1982 | Dahlgren |
| 4,340,039 | A | 7/1982 | Hibbard et al. |
| 4,340,982 | A | 7/1982 | Hart et al. |
| 4,349,434 | A | 9/1982 | Jaworski |
| 4,359,790 | A | 11/1982 | Chalberg |
| 4,382,865 | A | 5/1983 | Sweeny |
| 4,385,969 | A | 5/1983 | Margolis |
| 4,414,115 | A | 11/1983 | The |
| 4,416,854 | A | 11/1983 | Nielsen |
| 4,420,463 | A | 12/1983 | Pocius et al. |
| 4,421,652 | A | 12/1983 | Heskett |
| 4,426,286 | A | 1/1984 | Puckett et al. |
| 4,504,387 | A | 3/1985 | LeMire et al. |
| 4,519,914 | A | 5/1985 | Etani |
| 4,525,881 | A | 7/1985 | Higginbotham |
| 4,533,476 | A | 8/1985 | Watkins |
| 4,552,658 | A | 11/1985 | Adcock et al. |
| 4,584,106 | A | 4/1986 | Held |
| 4,586,204 | A | 5/1986 | Daniels |
| 4,610,783 | A | 9/1986 | Hudson |
| 4,630,634 | A | 12/1986 | Sasaki et al. |
| 4,637,873 | A | 1/1987 | DeSousa |
| 4,661,041 | A | 4/1987 | Hessler |
| 4,676,894 | A | 6/1987 | Diamond et al. |
| 4,692,314 | A | 9/1987 | Etani |
| 4,761,208 | A | 8/1988 | Gram et al. |
| 4,780,197 | A | 10/1988 | Schuman |
| 4,798,028 | A | 1/1989 | Pinion |
| 4,798,339 | A | 1/1989 | Perry et al. |
| 4,816,177 | A | 3/1989 | Nelson et al. |
| 4,817,214 | A | 4/1989 | Stuessy |
| 4,818,389 | A | 4/1989 | Tobias et al. |
| 4,844,944 | A | 7/1989 | Graefe et al. |
| 4,857,112 | A | 8/1989 | Franninge |
| 4,867,196 | A | 9/1989 | Zetena et al. |
| 4,871,710 | A | 10/1989 | Denny |
| 4,876,003 | A | 10/1989 | Casberg |
| 4,880,547 | A | 11/1989 | Etani |
| 4,901,926 | A | 2/1990 | Klotzbach |
| 4,933,178 | A | 6/1990 | Capelli |
| 4,935,135 | A | 6/1990 | Schaer |
| 4,971,687 | A | 11/1990 | Anderson |
| 4,979,245 | A | 12/1990 | Gandini |
| 5,006,267 | A | 4/1991 | Vaughn et al. |
| 5,011,600 | A | 4/1991 | Mowka et al. |
| 5,029,594 | A | 7/1991 | Pierce, Jr. |
| 5,066,408 | A | 11/1991 | Powell |
| 5,069,851 | A | 12/1991 | Hicks et al. |
| 5,076,315 | A | 12/1991 | King |
| 5,122,274 | A | 6/1992 | Heskett |
| 5,126,172 | A | 6/1992 | Dore, III |
| 5,149,354 | A | 9/1992 | Delaney |
| 5,156,535 | A | 10/1992 | Budris et al. |
| 5,159,723 | A | 11/1992 | Benedict |
| 5,167,049 | A | 12/1992 | Burkitt, III |
| 5,198,118 | A | 3/1993 | Heskett |
| 5,202,020 | A | 4/1993 | Desjoyaux et al. |
| 5,204,004 | A | 4/1993 | Johnston et al. |
| 5,236,581 | A | 8/1993 | Perry |
| 5,238,585 | A | 8/1993 | Reed, Sr. |
| 5,245,221 | A | 9/1993 | Schmidt |
| 5,252,211 | A | 10/1993 | Searfoss, Jr. |
| 5,277,802 | A | 1/1994 | Goodwin |
| 5,292,580 | A | 3/1994 | Dore, III |
| 5,314,623 | A | 5/1994 | Heskett |
| 5,328,602 | A | 7/1994 | Brooks |
| 5,332,511 | A | 7/1994 | Gay et al. |
| 5,341,527 | A | 8/1994 | Schmidt et al. |
| 5,347,664 | A | 9/1994 | Hamza et al. |
| 5,352,369 | A | 10/1994 | Heinig, Jr. |
| 5,372,714 | A | 12/1994 | Logue, Jr. |
| 5,383,239 | A | 1/1995 | Mathis et al. |
| 5,392,472 | A | 2/1995 | Maxfield |
| 5,405,614 | A | 4/1995 | Ohsumi et al. |
| 5,405,644 | A | 4/1995 | Ohsumi et al. |
| 5,409,608 | A | 4/1995 | Yoshida et al. |
| 5,441,529 | A | 8/1995 | Dorsch |
| 5,441,711 | A | 8/1995 | Drewery |
| 5,507,948 | A | 4/1996 | Wargo et al. |
| 5,514,315 | A | 5/1996 | Watkins et al. |
| 5,525,215 | A | 6/1996 | Marchionda |
| 5,536,393 | A | 7/1996 | Weeks |
| 5,575,925 | A | 11/1996 | Logue, Jr. |
| 5,580,621 | A | 12/1996 | Kuszaj et al. |
| 5,656,159 | A | 8/1997 | Spencer et al. |
| 5,681,988 | A | 10/1997 | Koch et al. |
| 5,743,287 | A | 4/1998 | Rauchwerger |
| 5,755,962 | A | 5/1998 | Gershenson et al. |
| 5,762,797 | A | 6/1998 | Patrick et al. |
| 5,779,913 | A | 7/1998 | Denkewicz, Jr. et al. |
| 5,785,845 | A | 7/1998 | Colaiano |
| 5,798,339 | A | 8/1998 | Brandes |
| 5,810,043 | A | 9/1998 | Grenier |
| 5,810,999 | A | 9/1998 | Bachand et al. |
| 5,820,762 | A | 10/1998 | Bamer et al. |
| 5,824,218 | A | 10/1998 | Gasser et al. |
| 5,824,243 | A | 10/1998 | Contreras |
| 5,853,581 | A | 12/1998 | Rayborn et al. |
| 5,857,594 | A | 1/1999 | Ozturk |
| 5,862,545 | A | 1/1999 | Mathis et al. |
| 5,868,933 | A | 2/1999 | Patrick et al. |

5,888,384 A 3/1999 Wiederhold et al.
5,888,386 A 3/1999 Enright et al.
5,888,392 A 3/1999 Frizell
5,904,986 A 5/1999 Smith
5,919,554 A 7/1999 Watterson, III et al.
5,928,510 A 7/1999 Meredith
5,932,093 A 8/1999 Chulick
5,935,518 A 8/1999 Richard et al.
5,954,952 A 9/1999 Strawser, Sr.
5,980,740 A 11/1999 Harms et al.
5,980,761 A 11/1999 Boissie et al.
6,019,893 A 2/2000 Denkewicz, Jr. et al.
6,030,632 A 2/2000 Sawan et al.
6,038,712 A 3/2000 Chalberg et al.
6,065,161 A 5/2000 Mateina et al.
6,066,253 A 5/2000 Idland et al.
6,086,758 A 7/2000 Schilling et al.
6,122,775 A 9/2000 Jacuzzi et al.
6,132,603 A 10/2000 Mokrzycki et al.
6,138,703 A 10/2000 Ferguson
6,153,095 A 11/2000 Francisco
6,162,401 A 12/2000 Callaghan
6,165,358 A 12/2000 Denkewicz, Jr. et al.
6,170,095 B1 1/2001 Zars
6,171,496 B1 1/2001 Patil
6,182,681 B1 2/2001 Robertson et al.
6,190,547 B1 2/2001 King et al.
6,199,224 B1 3/2001 Versland
6,214,217 B1 4/2001 Sliger, Jr.
6,238,575 B1 5/2001 Patil
6,269,493 B1 8/2001 Sorensen
6,270,662 B1 8/2001 Gibson et al.
6,274,036 B1 8/2001 Ellis
6,279,177 B1 8/2001 Gloodt
6,280,617 B1 8/2001 Brandreth, III
6,282,370 B1 8/2001 Cline et al.
6,283,308 B1 9/2001 Patic et al.
6,287,466 B1 9/2001 Yassin
6,289,530 B1 9/2001 Miller et al.
6,294,095 B1 9/2001 Lewis
6,298,871 B1 10/2001 Pickens et al.
6,308,350 B1 10/2001 Marchionda
6,317,903 B1 11/2001 Brunelle et al.
6,328,900 B1 12/2001 King
6,331,432 B1 12/2001 Bautista et al.
6,340,431 B1 1/2002 Khan
6,342,841 B1 1/2002 Stingl
6,357,060 B1 3/2002 Gloodt
6,358,405 B1 3/2002 Leahy
6,358,425 B1 3/2002 King
6,360,380 B1 3/2002 Swart et al.
6,390,340 B1 5/2002 Lynch, Sr.
6,391,167 B1 5/2002 Grannersberger
6,395,167 B1 5/2002 Mattson, Jr. et al.
6,405,387 B1 6/2002 Barnes
6,409,864 B1 6/2002 Choi
6,419,839 B1 7/2002 Cox et al.
6,419,840 B1 7/2002 Meincke
6,444,129 B1 9/2002 Collins
6,453,484 B1 9/2002 Pinciaro
6,460,894 B1 10/2002 Weh et al.
6,471,856 B1 10/2002 Keith
6,497,822 B1 12/2002 Blanchette et al.
6,500,332 B1 12/2002 Martin et al.
6,511,605 B1 1/2003 Connelly, Jr.
6,517,727 B1 2/2003 Pickens et al.
6,523,192 B1 2/2003 Gloodt
6,540,916 B1 4/2003 Patil
6,544,415 B1 4/2003 King
6,558,538 B1 5/2003 Sciuilla et al.
6,562,242 B1 5/2003 King et al.
6,592,341 B1 7/2003 Olney
6,592,766 B1 7/2003 King
6,623,634 B1 9/2003 Whitehurst
6,630,106 B1 10/2003 Levy
6,641,787 B1 11/2003 Siggins et al.
6,651,825 B1 11/2003 Turner, Jr. et al.
6,666,974 B1 12/2003 Page
6,676,842 B1 1/2004 Scuilla et al.
6,688,490 B1 2/2004 Carlson
6,722,384 B1 4/2004 Gates
6,749,746 B1 6/2004 Mokrzycki
6,760,931 B1 7/2004 Mattson, Jr. et al.
6,792,925 B1 9/2004 Dworatzek et al.
6,797,028 B1 9/2004 Duffy
2001/0003217 A1 6/2001 Sorenson
2001/0013373 A1 8/2001 Wright
2001/0027573 A1 10/2001 Gloodt
2002/0113025 A1 8/2002 Gauldin et al.
2002/0117432 A1 8/2002 Lincks
2003/0029789 A1 2/2003 Patil
2003/0113378 A1 6/2003 Laridon et al.
2003/0150796 A1 8/2003 Heinig, Jr.
2003/0178374 A1 9/2003 Arata
2003/0213059 A1 11/2003 Mattson, Jr. et al.
2004/0025249 A1 2/2004 Berry
2004/0168249 A1 9/2004 Gerth et al. ..... 4/541.6
2004/0168962 A1 9/2004 Mattson et al.
2004/0188346 A1 9/2004 Clive et al.
2004/0250344 A1 12/2004 Selover

FOREIGN PATENT DOCUMENTS

DE 19961049 6/2001

OTHER PUBLICATIONS

"Ozone Generators that are Sold as Air Cleaners & an Assessment of Effectiveness and Health Consequences" http://www.epa.gov//Aq/pubs/ozonegen.html#how%20is%20 harmful, visited Jan. 16, 2005 EPA Website 9 pages.
Lasco Cleaning—Circulation System p. 19 and 24.
Frequently Asked Questions-Sanijet Website—William J. Costerton Phd. Microbroligist.
Bio Films a Growing Problem William J. Costerton Phd Mircobroligist.
Decorative Plumbing Sep. 12, 2000 F.A.Q #4 Airtub.
Dr. Christine Pasko-Kolva P.h.D Enviromental Group Learer. Sanijet Website.
Hyrotheaphy tub Usage By: Scott Budgell and Bernice Thompson.
Merram—Website Online Dictionary Whirlpool Bath.
Rite Moyes, Ph.D Director of the Microbiology Labratory Texas A&M University—Sanijet Website.
What is ozone U.S. Enviromental Protection Agency.
Canadian Infection Control Guidelines for Long-Term Facilities, Rev, 1993 (pp 8-9).
Class Action Reporter Nov. 19, 2001, vol. 3, No. 226.
Lasco Bathware, Inc. Acrylic Builder's Choice Whirlpools Alydar I & II, Information Page (2 pages).
American Standard Bathroom Fixtures and Faucets, Product Details, Internet Web Page at www.americanstandard-us.com., Apr. 14, 2004, 2 pages.
Antimicrobial Alphsan® RC products—By: Milliken Chemical 3 pages Date Aug. 18, 2004.
Antimicrobial Alphasan® test Report Summary table Date Mar. 14, 2003 8 pages.
Jacuzzi Builder/Comfort Bath Series—Installation and operating instructions K272000AC Dec. 2004 (35 Pages).
Eljer Contractor Series Whirlpools—Installation/Operating Instructions.
U.S. Appl. No. 10/015,305, filed Jun. 12, 2003, Laridon et al.
U.S. Appl. No. 10/619,993, filed Jan. 29, 2004, Laridon et al.
U.S. Appl. No. 10/015,872, filed Jun. 19, 2003, Laridon et al.

HYDROMASSAGE ANTIMICROBIAL WHIRLPOOL BATHTUB

REFERENCE TO RELATED APPLICATION

This non-provisional utility application is a continuation in part of parent application Ser. No. 11/114,844, filed Apr. 26, 2005, which is a continuation of Ser. No. 10/841,925, filed May 7, 2004, now abandon, which is a divisional of Ser. No. 10/211,497 filed Aug. 2, 2002, titled Non-Electric Sanitation Water Vessel System, which is now U.S. Pat. No. 6,760,931.

FIELD OF THE INVENTION

The present invention relates to a fill and drain jetted hydromassage whirlpool bathtub wherein certain components are impregnated with an antimicrobial to provide for reduction of bacteria

BACKGROUND

For over twenty-five years people have been trying to solve the problem of reducing bacteria in a whirlpool bathtub closed loop-plumbing system. The art is full of inventions that purge water from a system, introduce ozone into a system, add chemicals periodically into the system, dry the system and other ways. All of these known inventions teach away from the present invention.

OVERVIEW

There is confusion by some with the term "whirlpool bathtub". Sometimes people refer to an air tub having an air only system and a blower as a "whirlpool bathtub". There are "whirlpool" jet boats; "whirlpool" appliances, "whirlpool" washing machines, "whirlpool" garbage disposals and many other things people refer to as "whirlpool". Term exact term "whirlpool" is defined as, a body of water having a vortex. Therefore, if the term "whirlpool" does not have a designator, it is indefinite and can only be taken as a body of water having a vortex. A bathtub is not a whirlpool bathtub. The present invention is therefore, properly defined as hydromassage jetted whirlpool bathtub. This designates that present invention has a water pump, water jets that provide a hydromassage, and a suction inlet. Jetted hydro massage whirlpool baths have been employed to treat discomfort resulting from strained muscles, joint ailments and the like. More recently, such baths have been used increasingly as means of relaxing from the daily stresses of modern life. A therapeutic effect is derived from water jets that create an invigorating hydromassage of the user's body.

To create the desired whirlpool motion and hydro massage effect, a motorized water pump draws water through a suction fitting in a receptacle, such as a bathtub. The user first fills the bathtub. Then the user activates the closed loop whirlpool system. The water travels through a piping system and back out jet fittings. Jet fittings are typically employed to inject water at a high velocity into a bathtub. Usually the jet fittings are adapted to aspirate air so that the water discharged into the receptacle is aerated to achieve the desired bubbling effect. See for instance, U.S. Pat. No. 4,340,039 to Hibbard et al., incorporated herein by reference. Hibbard et al also teaches one whirlpool bathtub having jet components. U.S. Pat. No. 6,395,167 to Mattson, Jr. et al. ("Mattson"), which is incorporated herein by reference teaches another embodiment of a whirlpool bathtub. U.S. Pat. No. 6,760,931 to Mattson, Jr. et al., which is incorporated herein by reference, teaches an antimicrobial whirlpool bathtub. One known antimicrobial compound that is known to inhibit bacteria growth is found in U.S. patent application Ser. No. 10/619,993 to Laridon et al, which is incorporated herein by reference. Laridon discloses thermoplastic article comprising at least one silver-containing antimicrobial agent. Another known antimicrobial is disclosed in Mattson '931 and consisting of 2,4,4-trichloro-2-hydroxy diphenol ether and 5-chloro-2phenol (2,4 dichlorophenoxy) compounds.

Generally, whirlpool baths are designed as with a normal bathtub to be drained after each use. However, debris in the form of dead skin, soap, hair and other foreign material circulates throughout the piping and pump system. This debris does not completely drain and over time, accumulates in the piping system and may cause a health risk.

Because some liability issues have been raised in regards to the effects of bacteria growth in a whirlpool bathtub and particularly bacteria growth between whirlpool bathtub uses, whirlpool bathtub manufacturers are now recommending expensive and time consuming periodic flushing requirements for their whirlpool bathtubs. For instance, Installation Instructions and Operations and Maintenance Guide LAB-WP-IP-11/02-20M-WP, published by Lasco Bathware, Inc., 8101 E. Kaiser Blvd., Anaheim, Calif. 92808, instructs a user on how to install, operate, and maintain a jetted bath properly and safely. Page 19 of Lasco's Guide under the heading "Circulating System" states:

> " . . . [W]e recommend that you purge it [whirlpool] at least twice a month, or more depending upon use . . . . Fill the bath with hotwater . . . . Add to the hot water, 4(6) tablespoons of low foaming detergent such as liquid Cascade or Calgonite and 24(48) oz. of liquid household bleach . . . . Turn air induction completely off. Run the bath for 5 to 10 minutes. Drain the bath completely and refill with cold water only. Run the whirlpool for 5–10 minutes. Drain the bath completely and refill with cold water only. Run the whirlpool for 5 to 10 minutes, then drain bath completely."

On its website at www.sanijet.info/faq.htm. Sanijet Corporation, 1462 S. Beltline Road, Coppell, Tex. 75019, publishes information regarding whirlpool bath systems that consumers have a right to know. Sanijet cites Rita Moyes, Ph.D., Director of the Microbiology Laboratory, Texas A&M University, who tested over 40 whirlpool bath water samples from homes and hotels across the country, as having determined that all of the samples tested positive for at least one type of (and frequently more) pathogenic bacteria or fungus.

> "Since December 1998, I have been conducting tests on the microbial content of whirlpool bath water from piped whirlpool baths in homes and hotels across the nation. These tests were conducted on aseptically collected samples sent to me in sterile containers, which were then subjected to standardized laboratory tests to assess relative bacterial numbers. All piped whirlpool bathtubs present identical dangers of microbial propagation because the biofilms, which constitute the bacterial environment, collect and remain on the interior of the piping. All tub samples tested contained microorganisms including enteric organisms, fungi, *Pseudomonas sp., Legionella sp.,* and *Staphylococcus aureus.* The enteric bacteria cause 30–35% of all septicemias (blood infections), >70% of urinary tract infections, and many intestinal infections. *Pseudomonas aeruginosa* has been implicated in infections of the respiratory tract, burn wounds, urinary tract, ear, and eye. It can also cause bacteremia, endocarditis, and gastroenteritis. All *Pseudomonas sp.* can cause opportunistic infections in immunocompromised patients. *Legionella* is the causative agent of Legionnaires' disease (with a 20% mortality rate) and Pontiac fever. *Staphylococcus aureus* causes a number of cutaneous infections including impetigo, folliculitis, furuncles, carbuncles, and wound infections. *S. Aureus* also release a toxin, which is responsible for scalded skin syndrome, toxic shock syndrome, and food poisoning. *S. aureus* is also an etiological agent for bacteremia, endocarditis, pneumonia, empyema (pus in the plural cavity), osteomyelitis, and septic arthritis. This was just a preliminary study and I tested for only a few types of organisms but it should be obvious that the presence of these microorganisms illustrate the potential health risk the bather exposes themselves to upon each entry into the tub."

"Any piped system will propagate harmful microbes which can and do cause sickness and death in humans."

"Due to the presence of pathogenic and potentially pathogenic organisms, education of the public on the hazards of piped whirlpool bathtubs use should become a priority."

Rita Moyes, Ph.D., as cited in *Sanijet Frequently Asked Questions, Question No.* 6 *regarding evidence that shows piped whirlpool circulation systems promote the growth of infectious microorganisms* (visited Jun. 23, 2003) <http://www.sanijet.cinfo/faq.htm>.

Sanijet cites Dr. Jon R. Geiger, Ph.D., Group Leader, Microbiology, Olin Research Center Cheshire, Connecticut, as stating:

"I suspect that [air induction systems] may be a reservoir for all kinds of organisms . . . organics provide food and shelter for microorganisms, including possible pathogens."

Jon R. Geiger, Ph.D., as cited in *Sanijet Frequently Asked Questions, Question No.* 12 *regarding the identification of the Legionella organism in piped whirlpool baths* (visited Jun. 23, 2003) <http://www.sanijet.cinfo/faq.htm>.

Sanijet cites William J. Costerton, Ph.D., microbiologist, Director of the Center for Biofilm Engineering (CBE), Montana State University, as stating:

"The CBE is the premier research institution for the study of the slimy surface aggregations of bacteria called biofilms. I coined the term 'biofilm' . . . in an article in Scientific American (February 1978), and have since published more than 400 research papers on this topic."

William J. Costerton, Ph.D., as cited in *Sanijet Frequently Asked Questions, Question No.* 6 *regarding evidence that shows piped whirlpool circulation systems promote the growth of infectious microorganisms* (visited Jun. 23, 2003) <http://www.sanijet.cinfo/faq.htm>. Further, Dr. Costerton comments on a controlled study of a Jacuzzi piped whirlpool bath by a CBE research engineer:

"The data summarized in this report show, with scientific certainty, that biofilms are formed on the surfaces of the pipes that feed the jets, and that these biofilms contain very large numbers (hundreds of thousands of cells per square centimeter) of heterotrophic bacteria, including many cells of *Pseudomonas aeruginosa*. This test reconfirms the widely known fact that biofilm forms in piped systems of this nature and it will form similarly in any whirlpool tub that humans use for bathing which utilize a piped circulating system. Irrespective of how well the system drains, water adheres to the interior pipe walls and this is the initial mechanism by which the bacteria are able to attach to the surfaces and thereafter begin the process of forming biofilm. Because small particles are always entrained in bubbles, the whirlpool jets produce an aerosol that contains bacteria from these biofilms, and direct observations of this test system have shown that the aerosol contains sessile bacteria in matrix-enclosed biofilm fragments. It is therefore a scientific certainty that any person using this whirlpool bath, with the jets in operation, would be exposed to airborne biofilm fragments containing pathogenic bacteria. While it cannot be predicted with certainty which bathers will develop overt pulmonary disease, it can be stated with scientific certainty that all bathers will have been exposed to the potentially hazardous aspiration of biofilm fragments as a result of using this whirlpool bath."

"The chance of infection during any given bath cannot be predicted with mathematical precision because contact with, or duration of, the bacteria is a random event depending on many variables. However, it is scientifically certain that all bathers are exposed to an environment conducive to infection and—if they are bathing in the typical nude fashion and having no device filtering the air they breathe—which, of course, is the usual procedures, they are taking no precaution against infection in an environment where they are surrounded by microscopic disease causing organisms and, unbeknownst to them, they should be taking precautions."

"Our experience in the cleaning of biofilm colonized pipes, for the re-use of these systems in laboratory experiments, indicates that a 24-hour exposure to bleach (at a sustained hypochlorite concentration of more than 2%) is necessary to kill bacteria in biofilms and to remove the biofilm matrix from these surfaces. If the matrix material is not removed, the regrowth of the biofilms is very rapid (less than 2 days), while perfectly clean surfaces will re-foul in +/−4 days. Because these effective measures would be beyond the resources of even the most fastidious spa owners, there is essentially no way to keep units designed in this way free from biofilms that constitute a real risk to human health.".

It is well known in the art that biofilms are produced by microorganisms and consist of a sticky rigid structure of polysaccharides and other organic contaminants. This slime layer is anchored firmly to a surface and provides a protective environment in which microorganisms grow. Biofilms generally form on any surface that is exposed to non-sterile water or other liquids and is consequently found in many environmental, industrial and medical systems.

Sanijet cites Michael Nicar, Ph.D., Epidemiologist, board certified in clinical chemistry and pulmonary function testing, and credentialed in the field of human disease testing and research, as stating "The relative risk for transmission of *Legionella* via whirlpools, is significant (The Lancet 347:494, 1996), even for people standing next to the whirlpools (they did not even have to get in to the water). The drain and fill whirlpools make aerosols just like the hot tub models. Thus, the transmission of disease is the same between the drain and fill and the constant filled hot tub models."

"Physicians need to know that [whirlpool bathtubs] are a source of exposure to *Legionella* bacteria. Otherwise, an erroneous diagnosis and incorrect choice of therapy may result . . . . Delay of appropriate therapy can result in prolonged hospitalization, complications, and death . . . "

Michael Nicar, PhD., as cited in *Sanijet Frequently Asked Questions, Question No.* 13 *regarding assessments a consumer can make about the health risk of using a piped whirlpool bath* (visited Jun. 23, 2003) <http://www.sanijet.cinfo/faq.htm>.

Sanijet cites Dr. Christine Pasko-Kolva, Ph.D., Environmental Group Leader Perkin Elmer, Foster City, Calif., as stating:

"I think it is very important to point out that the CDC has used that test [PCR] in other outbreaks in Colorado of a hot tub where the disinfectant level was at the appropriate concentration, yet there was still an outbreak. These protozoans [with *Legionella* engulfed in them] can insist, and once they insist they can be resistant to concentrations up to 50 ppm of free chlorine . . . after exposure to 50 ppm . . . amoeba cysts were able to exit and release the *Legionella.* So disinfection alone is not going to solve the problem. We do know that the infectious dose [of *Legionella*] is considerably low because it's an intracellular infection . . .

Christine Pasko-Kolva, Ph.D., as cited in *Sanyet Frequently Asked Questions, Question No.* 12 *regarding the identification of the Legionella organism in piped whirlpool baths* (visited Jun. 23, 2003) <http://www.sanijet.cinfo/faq.htm>.

Sanijet cites E. Tredget, MD et al., "Epidemiology of Infections with *Pseudomonas aeruginosa* in Burn Patients: The Role of Hydrotherapy", Clinical Infectious Diseases 1992, as stating:

"Outbreak of pseudomonas infection, including multiple deaths, in burn treatment unit was attributed to hydrotherapy tubs (piped whirlpool baths) despite rigorous disinfectant procedures after each use, leading to the discontinuance of hydrotherapy."

"*P. Aeruginosa* is a opportunistic gram-negative pathogen that thrives in an aquatic environment and has been identified as the cause of numerous outbreaks of skin infection transmitted to unburned patients and health care workers by medical equipment used for hydrotherapy. Because the organism was recovered from hydrotherapy equipment, this form of treatment was stopped and the strain of *P. aeruginosa* associated with the epidemic was eradicated . . . This outbreak occurred despite weekly surveillance cultures of this equipment and the use of standardized protocols for its disinfections between uses."

E. Tredget, MD et al., as cited in *Sanijet Frequently Asked Questions, Question No.* 6 *regarding evidence that shows piped whirlpool circulation systems promote the growth of infectious microorganisms* (visited Jun. 23, 2003) <http://www.sanijet.cinfo/faq.htm>.

In addition, Sanijet cites Canadian Infection Control Guidelines for Long-Term Care Facilities, which emphasize the necessity of having complete component and system disinfection:

"Single-use recirculating hydrotherapy equipment, such as bath tubs, century tubs, hubbard tanks and whirlpools, must be drained after each resident use. *Pseudomonades, legionellae* and other bacteria thrive in the warm, moist, dark environment of the internal plumbing of these units. Given the opportunity, they may form a semi-permanent biofilm, which can provide a never-ending reservoir of bacteria within the system. It is necessary to disinfect all components of the unit, including the basin, the internal plumbing and the lift chair with a disinfectant-detergent . . . . Prior to the first use of the day, it is necessary to disinfect the entire system . . . as *organisms may have survived the disinfection process of the previous day and multiplied.*" (emphasis added.)

Canadian Infection Control Guidelines for Long-Term Care Facilities, Rev. 1993 (pp. 8–9) as cited in *Sanijet Frequently Asked Questions, Question No.* 6 *regarding evidence that shows piped whirlpool circulation systems promote the growth of infectious microorganisms* (visited Jun. 23, 2003) <http://www.sanijet.cinfo/faq.htm>.

Mattson was the first to provide a method of reducing bacteria growth in a jetted hydromassage closed loop plumbing system by impregnating the components with an antimicrobial.

Making components of the water vessel system out of a material that provides for bacteria reduction is desirable. Providing canted piping is also desirable. Providing drain down fittings is further desirable. Making the tub surface out of a non-porous acrylic surface is also desirable because it is widely known that a non-porous surface does not have pores and porous surfaces are known to trap debris. The reduction of water in the system after drainage of the tub is important because the less water retained usually the less source there is for bacteria growth. Many antimicrobials only reduce or inhibit the growth of bacteria. One embodiment of the present invention provides for the reduction of bacteria. Another embodiment of the present invention provides to inhibit bacteria growth.

The term antimicrobial as used herein means the antimicrobial is bactericidal or bacteriostatic. The term "bactericidal" as used herein means the killing of microorganisms. The term "bacteriostatic" as used herein means inhibiting the growth of microorganisms, which can be reversible under certain conditions. The term antibacterial used herein, means that the antimicrobial reduces bacteria over 90% over a time period.

As used herein, the terms "non-leachable" or "substantially non-leachable" means that none or very minute amounts (e.g., below a certain threshold) of the organic and/or biocidal material dissolves into a liquid environment. Preferably, this threshold is no higher than 1 part per million (ppm), and more preferably is lower than 100 parts per billion (ppb).

As used herein, the term, closed loop also means water vessel system.

In one embodiment of the present invention it is preferable that an antimicrobial compound is preferably added in an amount from 0.001 to 15% by weight. In other words, if the material weights 1 ounce the antimicrobial part of the material added would be 0.001 to 15% of one ounce.

In one embodiment of the present invention it is preferable that an antimicrobial element is preferably added in an amount from 0.001 to 15% by weight. In other words, if the material weights 1 ounce the antimicrobial part of the material added would be 0.001 to 15% of one ounce.

In one embodiment of the present invention it is preferable that an antimicrobial substance is preferably added in an amount from 0.001 to 15% by weight. In other words, if the material weights 1 ounce the antimicrobial part of the material added would be 0.001 to 15% of one ounce.

One embodiment of the present invention uses one silver-containing antimicrobial agent and carboxylic acid salt.

Hydromassage jetted whirlpool bathtubs comprising acrylic, fiberglass and resin are known in the art.

One embodiment of the present invention uses a substantially non-leachable antimicrobial. Substantially non-leachable antimicrobials are known in the art.

Components of various embodiments described herein, or envisioned and not described herein, including but not limited to a tub, piping, jets, suction fitting air controls, tub, tub surface, pump, air controls, elbow fittings, couplers, connectors, heaters, water level sensors, pillows, lights to illuminate water, bacteria sensor or sensors, lights for therapy, vibration systems, pulsating jets, jets that travel in one direction or another, sound systems, visual systems, alert systems, emergency systems, removable seats, and other components can be made out of various materials can be made out of a material having antimicrobial properties. Such materials may or may not include and are not limited to metals, metals comprising zinc, metals comprising cadmium, metals comprising silver, metals comprising gold, metals comprising copper, metals comprising cadmium, metals comprising, aluminum, metals comprising iron, metals comprising steel, plastic, A.B.S. plastic, P.V.C. Plastic, Acrylic plastic, foam and other material, substances or elements. Each of these materials, substances or elements have or may have antimicrobial properties therein, are made to made antimicrobial properties therein, or are treated with substances comprising antimicrobial properties or having antimicrobial properties. The components herein have no limitation as to shape, size or configurations as all shapes; sizes and configurations are envisioned and fall into the scope of the present invention.

The following list is some antimicrobial substances or elements that make up antimicrobial substances or compounds that known in the art. The present invention could use one or more of these known elements or substances or a combination of these elements or substances:

Zinc, 2-methylthio-4-tert-butylamino, mercury, triazines, cyclopropylamino, methylthio, cyclopropylamino-6-tert-butylamino-s-triazine, 2-methylthio, 4-ethylamino, 6-tert-butylamino-s-triazine, 2-methylthio-4-ethylamino-6-(.alpha., beta.-dimethylpropylamino)s-triazin e., cadmium, 2-methylthio, 3,5-dimethyltetrahydro, 1,3,5-2H-thiodiazine, 2-thione, copper salts, antimony, copper sulfate, silver salts, tetrachloro, 4,4,5-dichloro-2-n-octyl-4-isothiazolin, 3-one, N-butylbenzisothiazoline, 10.10'-oxybisphenoxyarsine, zinc-2-pyridinethiol-1-oxide or zinc oxide, silver, gold, palladium and other antimicrobials.

The antimicrobial agent art is full of examples of agents, including silver (see Patil '916, column 2, line 58), zinc, cadmium, mercury, antimony, gold, aluminum, copper, platinum, and palladium; see U.S. Pat. No. 6,030,632 (2000) to Sawan et al. filed Sep. 11, 1998 and references cited therein. One embodiment of the present invention may utilize one or more of these antimicrobial substances.

The following antimicrobial compounds are known in the art and one, each, or a combination thereof are used in one embodiment of the present invention. Other antimicrobial compounds also may be used in embodiments of the present invention or contemplated embodiments of the present invention.

Antimicrobial agents selected from the group consisting of propiconazole, sodium pyrithione and mixtures thereof.

Antimicrobial agents selected from the group consisting of tolyl diiodomethyl sulfone; tebuconazole; thiabendazole; 3-iodo-2-propynyl butylcarbamate; and mixtures thereof.

Antimicrobial agents selected from the group consisting of 2,4,4'-trichloro-2-hydroxy diphenol ether and 5-chloro 2 phenol (2,4 dichlorophenoxy) compounds.

Antimicrobial agents selected from the group comprising 5-chloro-2-(2,4-dichlorophenoxy)phenol and polyhexamethylene biguanide hydrochloride where the antimicrobial agent present in the composite may be in the amount of from about 0.1 percent to about 5.0 percent by weight.

Antimicrobial agents selected from the group consisting of 5-chloro-2-(2,4-dichlorophenoxy)phenol and polyhexamethylene biguanide hydrochloride.

Antimicrobial agents selected from a group comprising, hydrophilic material containing chlorite anions, the hydrophilic and hydrophobic materials being adjacent and substantially free of water, the hydrophilic material being capable of releasing chlorine dioxide upon hydrolysis of the acid releasing agent.

These antimicrobial compounds are shown by way of example and not limitation as the present invention can use other known antimicrobial compounds or antimicrobial compounds that have not yet been developed.

The piping, fittings, pump, air channel, air controls and other components of the present invention are extruded; cast, injected, formed, vacuum formed or made using some other method. These components can also be made with U.V. inhibitors. U.V.

The configuration of adding an antimicrobial or antimicrobial compound to components of a hydromassage whirlpool bathtub provides for bacteria reduction or the inhibiting of bacteria after tub drain down and between electrical system activation in a least that segments of the closed loop plumbing system where the antimicrobial or antimicrobial compound is therein.

The term "bacteria" as used herein includes any form of bacteria.

When describing each component having an antimicrobial therein, or treated with an antimicrobial, it is understood that the entire component, or segment of the component or components has an antimicrobial therein or is treated with an antimicrobial. It should not be inferred that the entire component must have the antimicrobial therein or the entire component must be treated with an antimicrobial.

It is to be understood that the invention is not limited in its application to the details of the particular arrangements shown, since the invention is capable of other embodiments. Also, the terminology used herein is for the purpose of description and not of limitation. Although certain embodiments of the present invention has been described with reference to disclosed embodiments, numerous modifications and variations can be made and still the result will come within the scope of the invention. No limitation with respect to the specific embodiments disclosed herein is intended or should be inferred.

COMMENTS ABOUT ACRYLIC

Acrylic sheet is heated and then generally vacuum formed into a mold. After some cooling the sheet is removed. Then a mixture of resin and fiberglass is sprayed into the backside of the acrylic. Other substances could be included in this mixture. This forms a tub. All embodiments of the present invention tubs are made from acrylic, plastic, metal or some other material though acrylic is most preferable. It is preferable that a user does not activate pump 3 or another pump hooked up to the present invention without the water level being over about 1" above the highest jet.

It is to be understood that the invention is not limited in its application to the details of the particular arrangements shown, since the invention is capable of other embodiments. Also, the terminology used herein is for the purpose of description and not of limitation. Therefore, the present invention is envisioned to have many different configurations and components and shapes and sizes and all of the variations fall into the scope of the present invention.

SUMMARY

The main aspect of one embodiment of the present invention is to provide a fill and drain hydro massage jetted antimicrobial whirlpool bathtub that reduces bacteria in the closed loop plumbing system.

Other aspects of this invention will appear from the following description and appended claims, reference being made to the accompanying drawings forming a part of this specification wherein like reference characters designate corresponding parts in the several views.

Before explaining the disclosed embodiments of the present invention in detail, it is to be understood that the invention is not limited in its application to the details of the particular arrangements shown, since the invention is capable of other embodiments. Also, the terminology used herein is for the purpose of description and not of limitation. Additionally, while certain embodiment and features are shown and described, one or more features can be substituted between the embodiments to form and claim other embodiments.

DETAILED DESCRIPTION OF DRAWINGS

Figure 1:
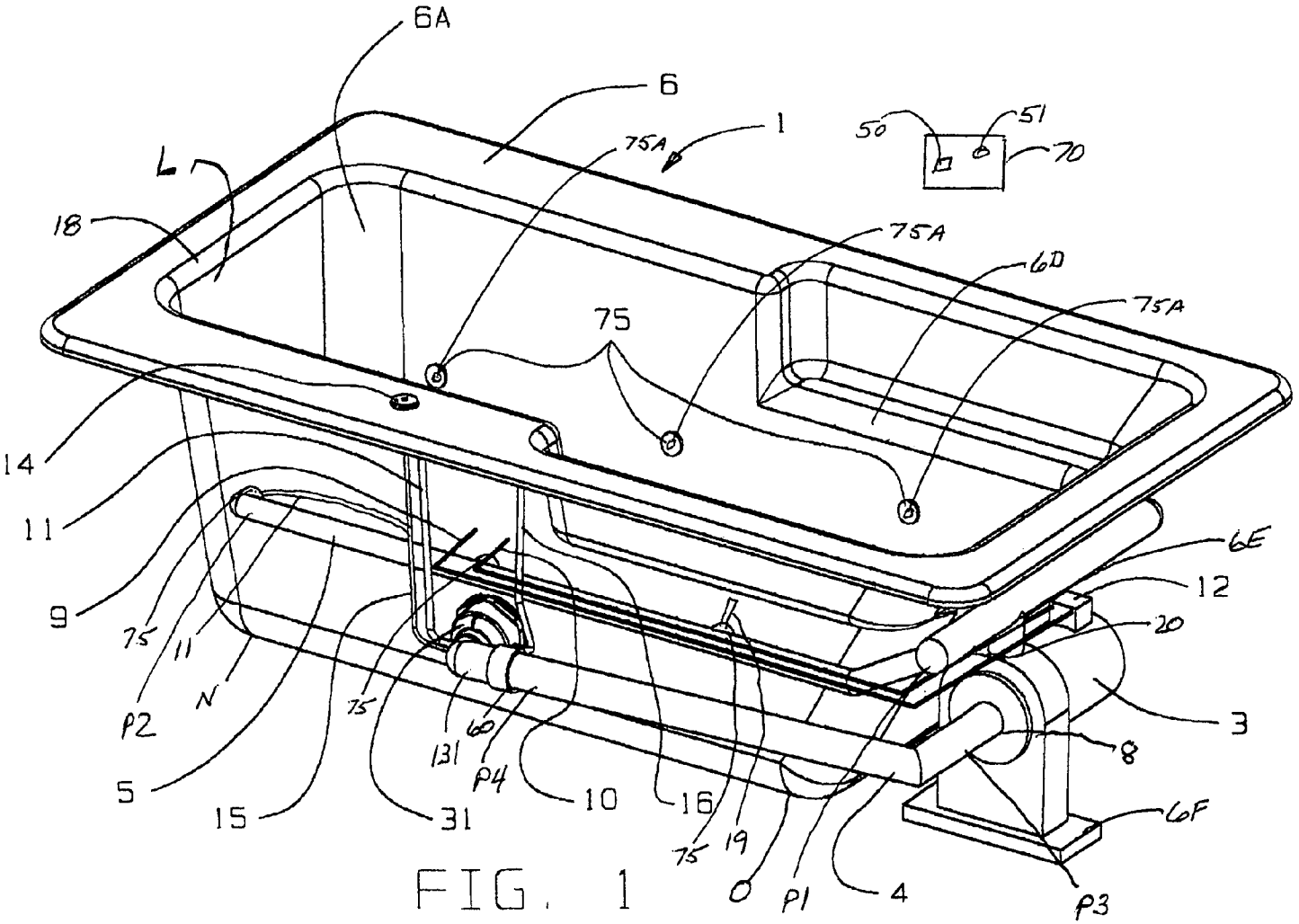
FIG. 1 is a plan view of one embodiment of the present invention.
Figure 2:
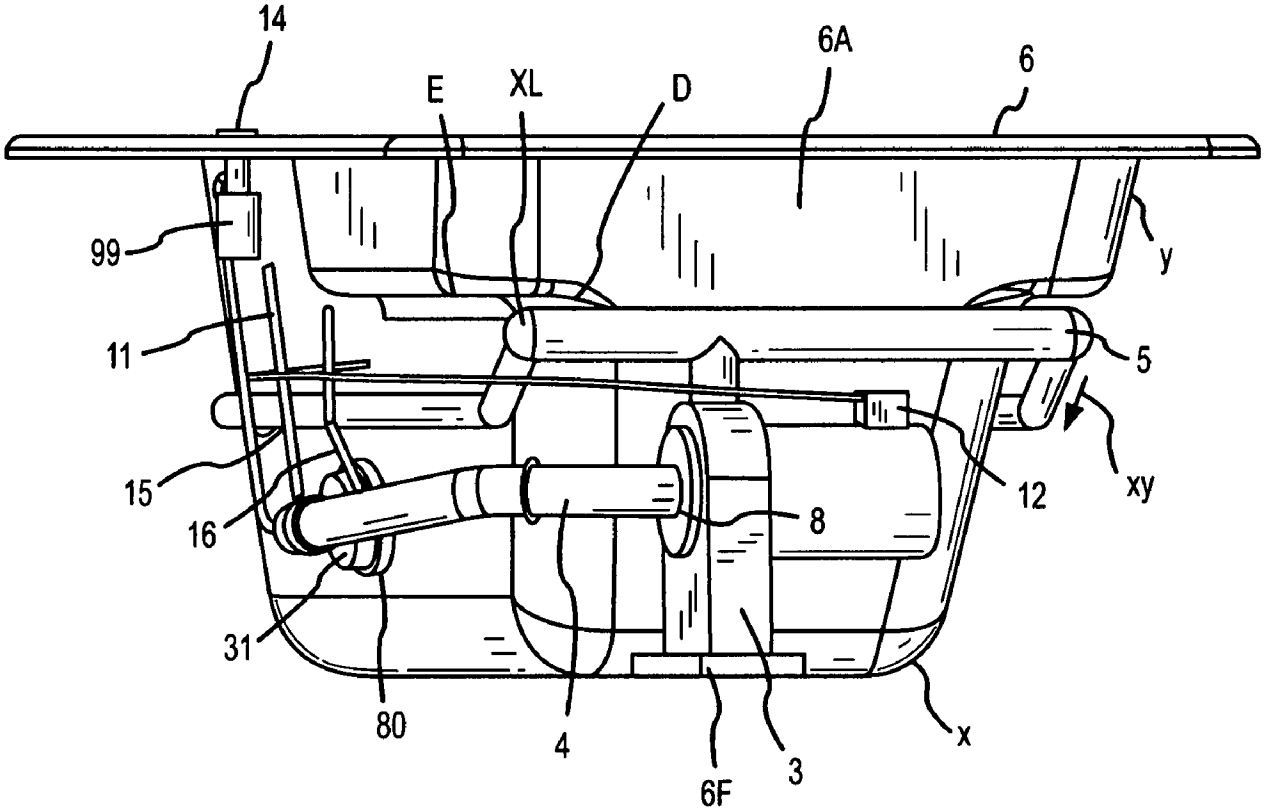
FIG. 2 is one embodiment of the present invention.
Figure 3:
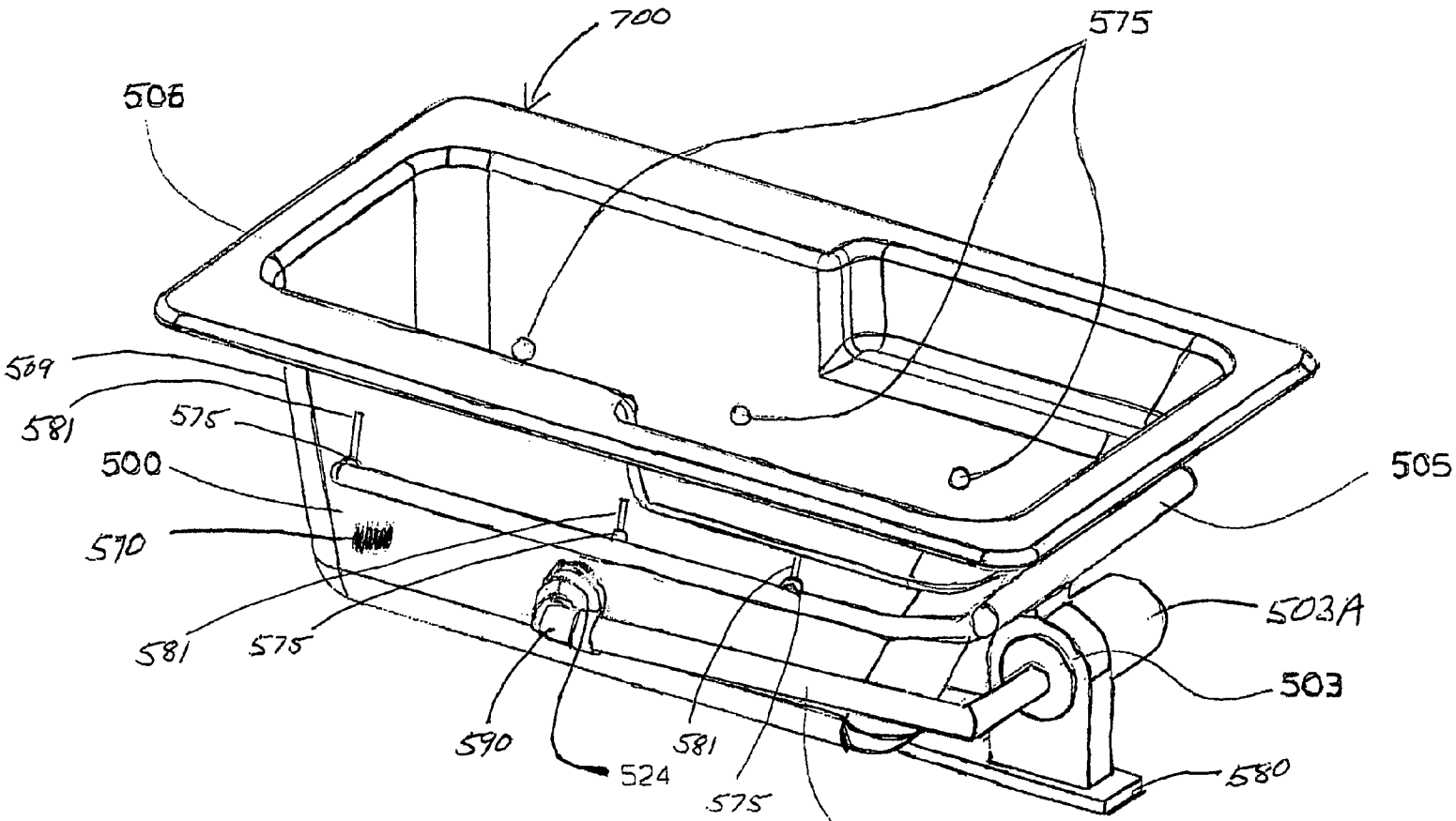
FIG. 3 is a top perspective view of one embodiment of the present invention, wherein one or more of the water vessel components are impregnated or treated with antimicrobial additives.

Referring first to FIGS. 1, 2, 3, a whirlpool bathtub water vessel 1 has a tub 6 with a standard tub wall 6A and a standard tub drain 8. During whirlpool use the pump/motor 3 circulates water via outlet pipe 5, and water jet fittings 75. Water is drawn from the filled tub 6 via pump inlet pipe 4, which is connected, to elbow 131 of water suction fitting 31. A switch 12 activates the pump 3. Air pipe or line 11 and air pipe or line 16 extend from water suction fitting 31. Air pipe 11 and 16 provide air to water jet fittings 75 and also could provide air to suction fitting 31. Air is drawn into airline 11 from air control 14. The water jet fittings 75 are also known as hydromassage jets, or jets, or jet. Air control 14 is adjustable so to adjust the amount of air that enters jet 75. Airlines 16 and 11 are shown by way of example and not limitation. Airline could connect to one or more jets. Air pipe 11 or 16 could also only connect to the jets 75 and not the suction fitting 31. Only one air pipe could also be utilized and could have a different configuration. Bacteria sensing probe 9 connects to tub wall 6A and the closed loop plumbing. Probe 9 senses bacteria and if bacteria is detected it sends a signal to switching 12 that illuminates a light (not shown) at the end of alert line 10 attached to tub sidewall 6A. The arrangement and configuration of bacteria sensing probe 9 and how works is shown and described by way of example and not limitation. The probe could have many configurations and operate in many different ways. Bacteria sensing probes are known in the art and a person schooled in the art would know how to configure bacteria probe to whirlpool bathtub 1. However, there is no prior art for a bacteria probe used on a whirlpool bathtub to detect bacteria and alert a user to the presents of bacteria in the closed loop plumbing system or the tub. Switch 12 also works in conjunction with Bacteria probe 9 and can stop the pump from operating if bacteria are detected. Likewise, switch 12 has an alarm to sound if bacteria probe 9 senses bacteria Sidewall 17 is sloped from position y to position X. The sloped tub wall is shown by way of example and not limitation as the tub could have more than one slope or no slope at all. Whirlpool bathtub water vessel 1 is shown having 6 jets (75). Whirlpool bathtub water vessel 1 having 6 jets retains less than 6½ ounces of water after tub drain down, but more preferably less than 3.9 ounces of water after tub drain down. In a to 12 jet system the whirlpool will hold less than 3.9 to 6 ounces of water. Inlet pipe 4 cants downward from water pump 3 to elbow 131 of suction fitting 31. The sloped angle position P1 to position P2 is over 2 degrees, but could have any degree of slope. Inlet pipe 4 preferably is about ½" to about 2" in diameter. However, inlet pipe 4 could have any diameter. ½ diameter pipe provides for water flow of over 80 gallons per minute to run through inlet pipe 4. However, inlet pipe 4 could have any diameter. Outlet pipe 5 preferably has an inside diameter of about 1" to about 1½". However, outlet pipe 4 could have any diameter. Pump 3 preferably is rated at over ½ horsepower; however, Pump 3 could have any horsepower rating. Pump 3 has water tee 6 E. Inlet pipe 4 is shown as a single pipe having a bend where the bend radius is at over a 45-degree angle and more preferably about 90 degrees from about position P1 to about position P2. The bend angle could have any angle degree. Pump 3 is shown with base 6 F and base 6 F could have any shape or size and be attached directly to tub 6. Pump/motor 3 is configured inside to have a sloped inside to provide drainage into inlet line 4 from pump 3 when tub 6 is drained. One configuration of jets 75 and suction fitting 31 can utilize a housing 50 shown in FIG. 6 having a sloped lower interior wall 51 that slopes from position A to position B. This slope compensates for tub wall 6 C allowing water in the piping 4 and 5 to drain into tub 6. The slope angle from A to B is over 2 percent but more preferably between 2 percent and 12 percent. The slope is shown by way of example and not limitation. The housing configuration is shown by way of example and not limitation as the housing could have any shape or configuration. Openings are cut into tub 6 for water fittings such as jets and suctions. Suction fitting 31 secures to tub 6 with an adhesive or some other way to provide preferably for a watertight seal. Elbow 131 secures to one end of suction elbow fitting 131 and inlet pipe 4, with an adhesive or some other way to provide preferably for a watertight seal. One end of inlet pipe 4 secures to pump 3 with an adhesive or some other way to provide preferably for a watertight seal. Inlet pipe 4 could connect to pump 3 with a connecting fitting (not shown) but known in the art or assemble to pump 3 in another way. Water tee 6E connects to pump 3 with an adhesive or some other way to provide preferably for a watertight seal. Water tee 6E is shown by way of example, as water tee 6E is optional. Water tee secures to outlet pipe 5 with an adhesive or some other way to provide preferably for a watertight seal. Inlet pipe 5 secures to jets 75 with an adhesive or some other way to provide preferably for a watertight seal. Jets 75 secure to tub 6 secures with an adhesive or some other way to provide preferably for a watertight seal. Tub 6, inlet pipe 4, outlet pipe 5, suction fitting 31 and jets 75 form a closed loop plumbing system. Inlet pipe 4, outlet pipe 5, suction fitting 31 and jets 75 form the enclosed portion of the closed loop plumbing system. Tub 6 has a drafted lower bottom (not shown) that allows water in the tub to drain to and out a drain opening (not shown) that is in the bottom of the tub. The color of the piping or the other components generally is white but could be blue, green, red or a variety of colors other than white. All components of the present invention are connected together using either an adhesive or are sonic welded together or attached together by some other method. Bacteria alert pad 70 attaches to whirlpool bathtub 1 and connects to bacteria sensing probe 9. The bacteria pad 70 has L.E.D. readout 50 that gives an indication of bacteria levels or if a bacterium is detected. Indicator light 51 also alerts a user to bacteria detection. Bacteria pad 70 is shown by way of example and not limitation as bacteria pad 70 could have any configuration or shape or alert methods and all of these are contemplated and fall into the scope of the present invention. Bacteria pad 70 can be placed anywhere on tub 6 or remote from tub 6. Jets 75 have adjustable nozzle 75A. Turning the nozzle one way reduces water flow or airflow while turning the nozzle in the opposite direction increases water or airflow through jets 75. Jets 75 are shown by way of example and not limitation as jets of any configuration can be used on the present invention. FIG. 1 shows 7 water fittings comprising 6 jet fittings 75 and 1 suction fitting 31. This configuration retains less than 4 ounces of water after tub drain down. Insulation 570 can be applied to the rear surface of the tub of any embodiment of the present invention. The insulation can be placed on the motor or pump. The canted downward angle of the inlet pipe from pump 4 to suction fitting 31 is over 1 degrees but more preferably over 4 degrees and most preferably over 6 degrees. Outlet pipe 5 is shown having a cant of over 2 degrees up to 15 degrees downward from about position P1 to about position P2. The cant or slope is shown by way of example and not limitation as the cant or slope could have different degrees. However, it is most preferable that the cant or slope is over 4 degrees. The tee 6E is shown higher than jets 75. However, tee 6E could be lower than jets 75. Pump inlet 8 is elevated in relationship to elbow fitting 131. This allows for water to efficiently drain from pump 3 into elbow 131 and into tub 6. Tub bottom cants downward from about position O to about position N and the cant is at least 1% but could be more. This allows water in the tub to drain through a drain (not shown) in the front of the tub. If the drain were in another location than the front of the tub, the tub bottom would cant towards where the drain opening is located. The cant and proposed drain location is shown or described by way of example and not limitation. Tub 6 is shown having a radius lip 18. The inside depth of the tub from position L to the drain opening (not shown) is over 14 inches. The depth is shown by way of example and not limitation as tub 6 could have any depth and all depths fall into the scope of the present invention. FIG. 2 shows pump base 6F attached to tub 6. Air pipe 19 is connected to jet 75. Air pipe 19 provides that air is pulled into jets 75 when pump 3 is activated. Air pipe 19 could be on each jet. Air pipe 19 is shown by way of example and not limitation. Pump inlet 8 could also have a quick disconnect (not shown) to make it easy to remove inlet pipe 4 from pump 3. Likewise a quick disconnect (not shown) could be attached to pump outlet 20. In FIG. 2 pump inlet 8 is shown elevated in relationship to the bottom 80 of suction fitting 31. This arrangement allows water in pump to drain to suction fitting 31 and into tub 6. In FIG. 2, outlet pipe 5 cants downward from position XL to position XY. A 1½ inch diameter pipe offers the present invention over 80 gallons of water flow per minute through inlet pipe 4. A 2 inch diameter pipe offers over 100 gallons per minute water flow through inlet pipe 4. The pipe diameters and suction fitting or elbow fitting diameters are shown by way of example and not limitation. The present invention could utilize any diameter pipe or have any diameter output or outlet orifices. All such diameters fall into the scope of the present invention. Tub 6 has an optional water level sensor. Water level sensors for whirlpool bathtubs are known in the art. In one embodiment of the present invention the water level sensor is positioned above jets 75. This provides that water must be overjets 75 before pump 3 can be activated. FIG. 2 shows an armrest having a slope or cant from position E downward to position D. The slope allows water in the armrest to drain back into the tub. The armrest and slope are shown by way of example and not limitation. The armrest could have any shape or configuration and all shapes and configurations fall into the scope of the present invention. "The tub, the wall fittings for water flow, the water pump, the inlet pipe for water flow and the outlet pipe for water flow are assembled to form a closed loop plumbing system for water flow" made without an armrest and this embodiment is contemplated and falls into the scope of the present invention.

It is to be understood that the invention is not limited in its application to the details of the particular arrangements shown, since the invention is capable of other embodiments. Also, the terminology used herein is for the purpose of description and not of limitation. Therefore, the present invention is envisioned to have many different configurations and components and shapes and sizes and all of the variations fall into the scope of the present invention.

FIG. 3 is a top perspective view of features of one embodiment of the present invention hydromassage whirlpool 700, wherein one or more component are impregnated with antimicrobial additives creating a water vessel sanitation system or antimicrobial whirlpool bathtub. The fiberglass/resin vessel backing 500, acrylic sheet 506, pump 503, motor 503A, jets 575, inlet pipe 504, outlet pipe 505 and air pipe 581 may individually or all be impregnated or treated with an antimicrobial, or antimicrobial additives, or agents, or antimicrobial compounds, or have antimicrobial properties. Though various components are shown as having an antimicrobial therein, it should be understood, that only one or more components need to have an antimicrobial. Hydromassage whirlpool 700, tub 509, fiberglass/resin vessel backing 500, acrylic sheet 506, pump 503, motor 503A, jets 575, inlet pipe 504, outlet pipe 505, air pipe 581, suction fitting 590 and pump base 580 are shown by way of example and not limitation. They each could have various sizes, shapes and configurations and all of these fall into the scope of the present invention. The antimicrobial can be placed in or on any known hydromassage whirlpool bathtub. Wet pipe 504 cants downward from pump 503 to suction fitting 590. These components can be made out of any material disclosed in the specifications or other materials. Optional insulation 570 may be applied to parts of hydromassage whirlpool 700.

Figure 4:
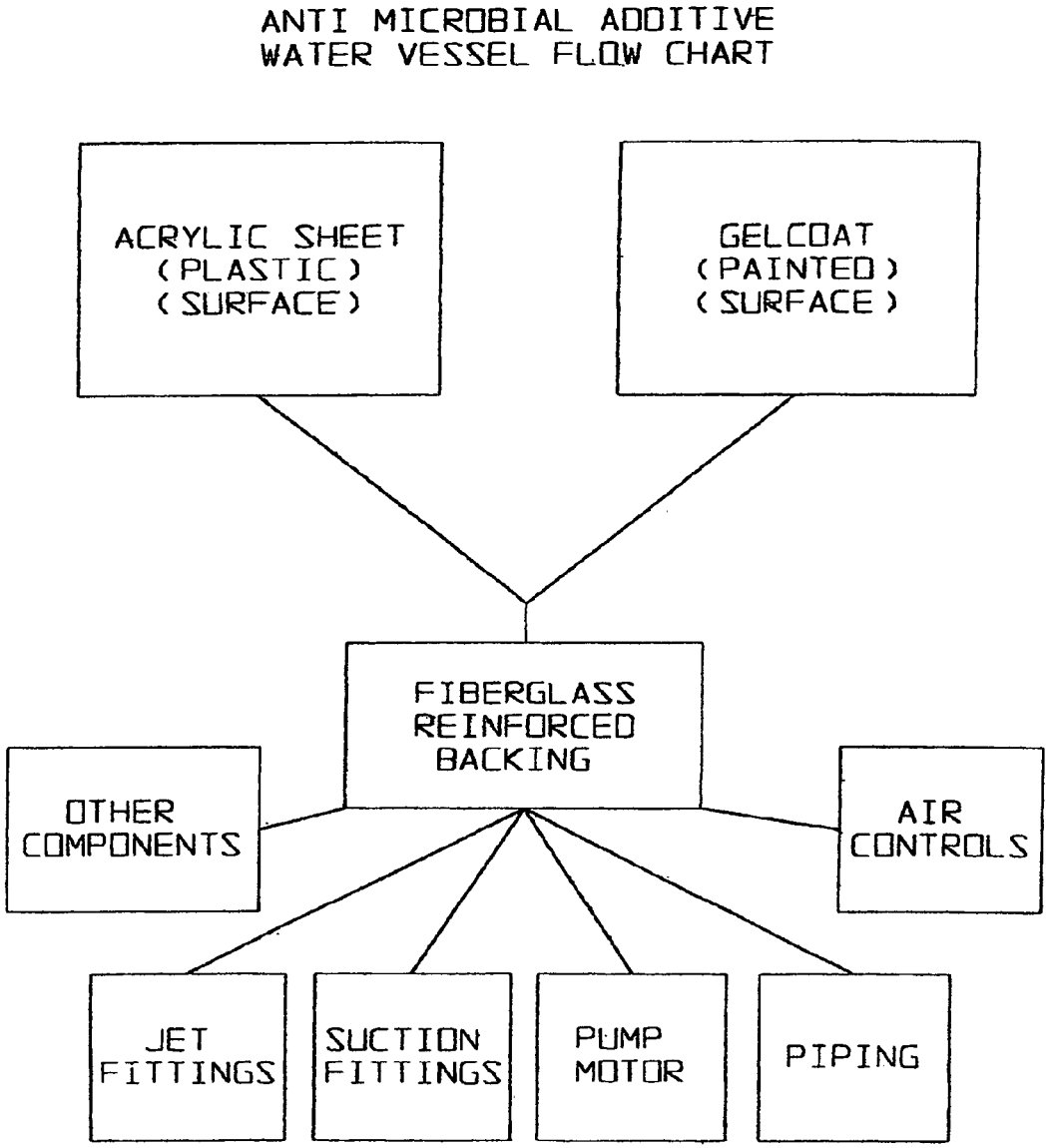
FIG. 4 is a flow chart illustration of a one embodiment of the present invention.

FIG. 4 presents a flow chart illustration of one embodiment of hydromassage jetted whirlpool bathtub of FIGS. 1, 2, 3. Antimicrobial additives may be added to one or more components of the whirlpool bathtub to provide for bacteria reduction or the inhibiting of bacteria growth, reduction of bacteria growth, protection from bacteria, inhibiting of biofilm growth, protection from biofilm growth, or the reduction of biofilm growth. The acrylic sheet or gelcoat surface may be treated at point of manufacture. In addition, fiberglass reinforced backing, air control (s), air piping, jet fitting (s), suction fitting (s), pump (s), motor (s), piping and other components may impregnated or otherwise treated with antimicrobial additives. It is to be understood that the invention is not limited in its application to the details of the particular arrangements shown, since the invention is capable of other embodiments. In one embodiment it is preferable that the antimicrobial is of sufficient type and concentration to provide to inhibit a growth of bacteria. In one embodiment, it is preferable that the antimicrobial is of sufficient type and concentration to provide for reduction of bacteria In one embodiment, it is preferable that the antimicrobial is of sufficient type and concentration to provide for over a 75% reduction of bacteria. In the most preferable embodiment it is preferable that the antimicrobial is of sufficient type and concentration to provide for over a 90% reduction of bacteria over a time period. One skilled in the art of chemical antimicrobial additives would know how to accomplish this. One embodiment of the present invention uses a silver-containing antimicrobial agent and from at least 0.001% to 15% by weight of the polymer of at least one carboxylic acid salt component. In one embodiment it is preferable that the antimicrobial is non-leaching. In on embodiment it is preferable that if any of the antimicrobial leaches, that the amount of the leached antimicrobial will not harm a user. Generally this amount is no higher than 1 part per million (ppm), and more preferably is lower than 100 parts per billion (ppb). Though many components shown are made of a material having an antimicrobial therein, it is understood that the present invention can have one or more components made of a material having an antimicrobial therein. Not all components are required to have an antimicrobial therein. Also, the terminology used herein is for the purpose of description and not of limitation. Although certain embodiments of the present invention has been described with reference to disclosed embodiments, numerous modifications and variations can be made and still the result will come within the scope of the invention.

It is to be understood that the invention is not limited in its application to the details of the particular arrangements shown, since the invention is capable of other embodiments. Also, the terminology used herein is for the purpose of description and not of limitation. Therefore, the present invention is envisioned to have many different configurations and components and shapes and sizes and all of the variations fall into the scope of the present invention.

Figure 5:
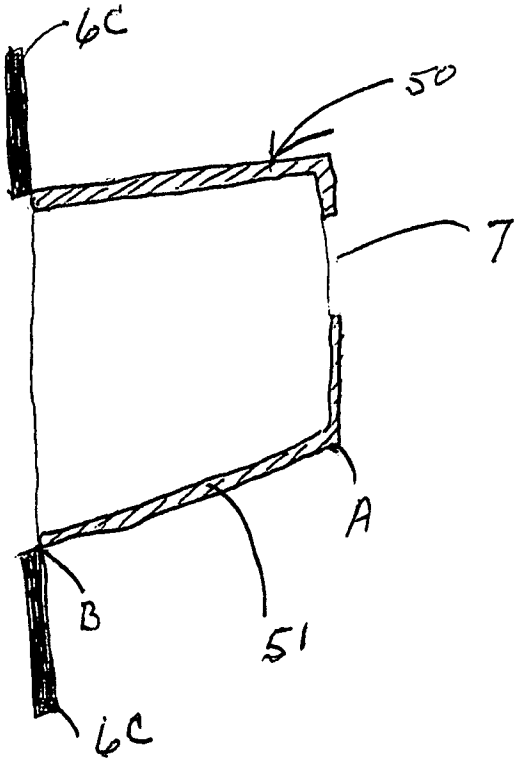
FIG. 5 is an air channel that could go onto or does attach to one of the embodiments of the present invention.

FIG. 5 shows housing 50 attached to tub sidewall 6C. The lower interior wall 51 that is sloped from position A to position B. Housing 50 could fit any jet fitting or suction fitting in the present invention. The slope is preferably enough to compensate for tub wall draft allowing water in the piping system, either outlet pipe 5 (not shown) or inlet pipe 4 (not shown) to drain into the tub. Housing 50 could have a tee or other configuration integrated or attached to orifice 7. Housing 50 is shown by way of example and not limitation has housing 50 could have and shape or configuration and all shapes and configurations fall into the scope of the present invention. Suction fitting output orifice is generally sized to accept a standard 1" to 2" diameter pipe that is known in the art.

It is to be understood that the invention is not limited in its application to the details of the particular arrangements shown, since the invention is capable of other embodiments. Also, the terminology used herein is for the purpose of description and not of limitation. Therefore, the present invention is envisioned to have many different configurations and components and shapes and sizes and all of the variations fall into the scope of the present invention.

Figure 6:
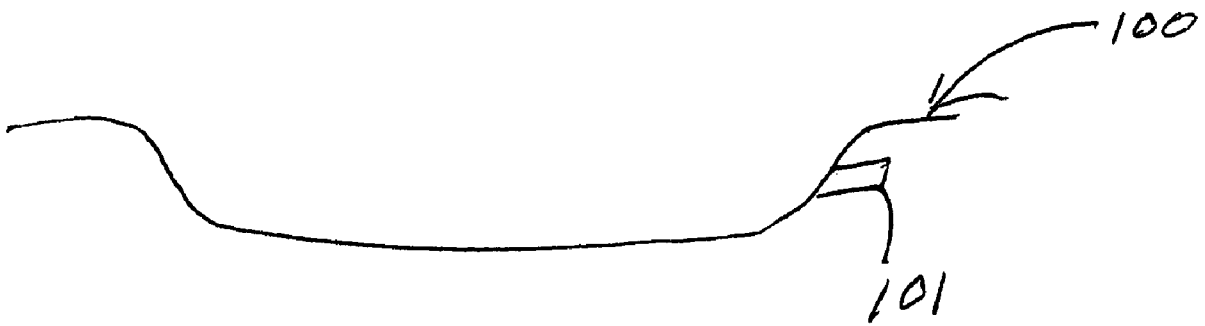
FIG. 6 is a housing with a sloped lower shelf.

FIG. 6 shows air channel 100. Air channel 100 can attach to tub 6 in FIG. 1 or any embodiment of the present invention. Air channels are known in the art and the attaching of an air channel to a tub is known in the art. Air channel 6 has connection 101 that is attached to an (air blower) not shown. The function of the air channel and how they work are known in the art. Air channel 100 is shown by way of example and not limitation. Air channel herein means any means to aid in transporting air into a tub and this includes an air pipe, air line or air hose. Air channel 100 could have any configuration or shape and all configurations and shapes fall into the scope of the present invention. Air channel 100 is made is a material having an antimicrobial therein. The air channel may also have air check valves (not shown) but widely known in the art to allow air to flow into a tub and inhibit water in the tub from entering the air channel.

It is to be understood that the invention is not limited in its application to the details of the particular arrangements shown, since the invention is capable of other embodiments. Also, the terminology used herein is for the purpose of description and not of limitation. Therefore, the present invention is envisioned to have many different configurations and components and shapes and sizes and all of the variations fall into the scope of the present invention.

Figure 7:
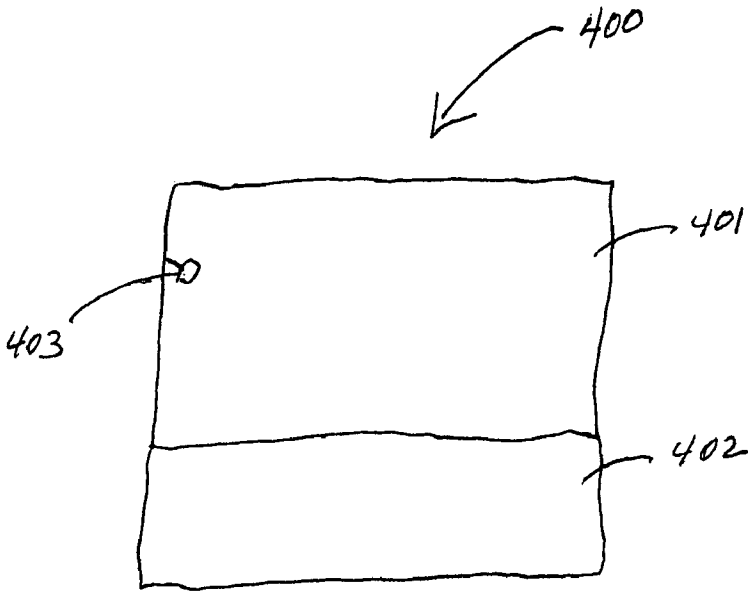
FIG. 7 shows one embodiment of a combination whirlpool bathtub and shower.

FIG. 7 shows one embodiment of a combination hydromassage whirlpool bathtub and shower 400. Shower wall 401 is integral or removable for whirlpool bathtub 402. Shower head 403 sprays water into the combination hydromassage whirlpool bathtub and shower 400. Shower wall 401 could have a sectional configuration. The combination hydromassage whirlpool bathtub and shower 400 could also have an access (not shown) to service the closed loop plumbing system (not shown). The arrangement and configuration of combination hydromassage whirlpool bathtub and shower 400 is only shown by way of example and not limitation. It could have any shape or configuration and all shapes and configuration fall into the scope of the present invention. Tub wall surround 401 or a variation of tub wall surround 401 can fit any embodiment of hydromassage whirlpool bathtubs shown herein.

It is to be understood that the invention is not limited in its application to the details of the particular arrangements shown, since the invention is capable of other embodiments. Also, the terminology used herein is for the purpose of description and not of limitation. Therefore, the present invention is envisioned to have many different configurations and components and shapes and sizes and all of the variations fall into the scope of the present invention.

Figure 8:
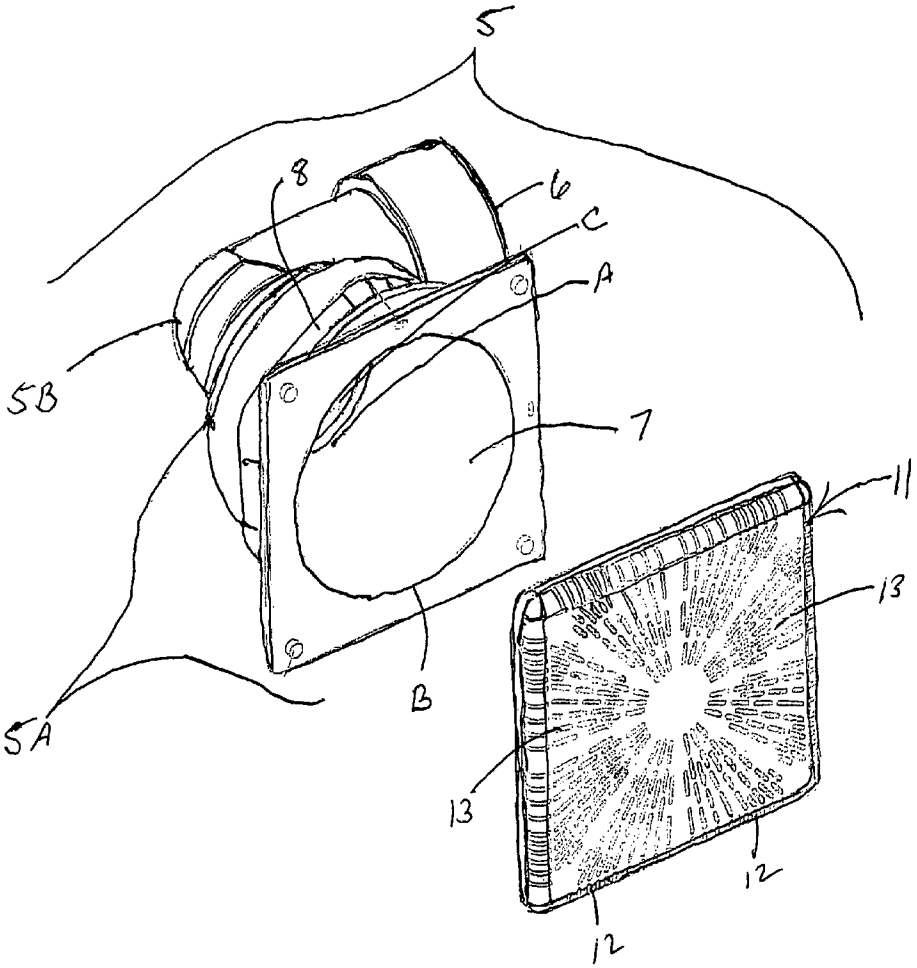
FIG. 8 shows one embodiment of a drain down housing with faceplate.

FIG. 8 Shows suction fitting 5 having housing 5A. Housing 5A has a downward slope from position housing outlet A to housing inlet position B. Elbow 5B attaches to housing 5A with an adhesive or by some other way. An opening (not shown) is cut into a wall of a tub, such as but not limited to tub 6 in FIG. 1. The housing is then placed through the opening. Nut 8 screws onto threads (not shown) on housing 5A and secures housing 5A to the tub. Elbow 5*b* is then attached to housing 5A. It is preferable that elbow 5B attaches to housing 5A so that elbow outlet 6 is canted upwards toward a pump. This allows elbow 5B to have a sloped interior wall. Elbow 5B at position C is higher than position A in housing 5A. The canting of elbow 5B and the slope from position A to position B compensates for tub wall draft. This allows water in an inlet pipe 4 as shown in FIG. 1 to drain through the elbow 5B through housing 5A and into a tub with a tub having a sloped sidewall. The slope from position A to position B can vary but is preferably between 2 to 12 degrees, but more preferably between 3 to 7 degrees and ideally between 4–6 degrees. Faceplate fits over housing 5A. Drainage openings 12 are along the bottom of faceplate 11. There could be one or more drainage openings 12. The shape, configuration and size of suction fitting 5 is shown only by way of example and not limitation as suction fitting 5 could have any shape, size and configuration. Faceplate 11 also has various inlet openings 13 for water flow. Suction fitting 5 can fit any embodiment in FIGS. 1, 2 and 3. It is important to note that housing 5A could be utilized with the faceplate 12 and housing 5B. That nozzles for water flow (jets) found in the incorporated by art herein could be adapted to housing 5A to provide for a drain down jet assembly. In this configuration and air pipe, as shown in FIG. 1, 2 or 3 would be adapted to housing 5A. One of skilled in the art would know how to accomplish this goal from reading this disclosure and using the prior art for jet fittings. Outlet A is offset higher that inlet B.

It is to be understood that the invention is not limited in its application to the details of the particular arrangements shown, since the invention is capable of other embodiments. Also, the terminology used herein is for the purpose of description and not of limitation. Therefore, the present invention is envisioned to have many different configurations and components and shapes and sizes and all of the variations fall into the scope of the present invention. Just because one embodiment shows certain features does not mean that embodiment requires those feature.

We claim:

1. A fill and drain whirlpool bathtub, comprising:

a tub having hydro massage water jets; an inlet water pipe; a water outlet pipe; a plurality of wall fittings for water flow; an air volume control; an air pipe for air flow; and a water pump;

wherein the inlet water pipe and the air pipe are made of plastic;

wherein the inlet water pipe is canted downward at over a four-degree angle from the water pump to one of the plurality of wall fittings for water flow;

wherein the inlet water pipe is adhesively secured to a separate elbow fitting to form a water tight seal between the inlet water pipe and the separate elbow fitting;

wherein the inlet water pipe, the outlet water pipe, at least one of the plurality of wall fittings for water flow, the air pipe, and the water pump are impregnated with 0.001 percent to fifteen percent by weight of a substantially non-leaching bacteriostatic antimicrobial;

wherein a threshold of released antimicrobial is no greater than 1 part per million;

wherein the substantially non-leaching bacteriostatic antimicrobial provides for over a seventy-five percent reduction of grain-negative bacteria over a period of time between tub drain down and electrical system activation; and wherein the substantially non-leaching bacteriostatic antimicrobial inhibits biofilm growth.

2. The apparatus of claim 1, wherein the tub, the inlet water pipe, the water outlet pipe, the plurality of wall fittings, the air volume control, the air pipe, and the water pump collectively retain less than four ounces of water after the tub is drained of water.

3. The apparatus of claim 1, wherein the antimicrobial comprises dichlorophenoxy.

4. The apparatus of claim 1, wherein the antimicrobial comprises metal.

5. The apparatus of claim 1, further comprising a bacteria probe, wherein the bacteria probe is configured for insertion and installation in a watertight fashion into the inlet water pipe or the water outlet pipe, and wherein electronics in the bacteria probe are sealed against dampness.

6. The apparatus of claim 1, wherein at least one of the plurality of wall fittings is configured to compensate for tub wall draft by allowing water to flow from the inlet water pipe or from the water outlet pipe and into the tub.

7. The apparatus of claim 1, wherein the tub comprises a non-porous acrylic surface.

8. A fill and drain whirlpool bathtub, comprising:

a tub having hydro massage water jets; an inlet water pipe; a water outlet pipe; a plurality of wall fittings for water flow; an air volume control; an air pipe for air flow; and a water pump;

wherein the inlet water pipe and the air pipe are made of plastic;

wherein the inlet water pipe is canted downward at over a four-degree angle from the water pump to one of the plurality of wall fittings for water flow;

wherein the inlet water pipe is adhesively secured to a separate elbow fitting to form a water tight seal between the inlet water pipe and the separate elbow fitting;

wherein the inlet water pipe, the outlet water pipe, at least one of the plurality of wall fittings for water flow, the air pipe, and the water pump are impregnated with 0.001 percent to fifteen percent by weight of a substantially non-leaching bacteriostatic antimicrobial comprised of metal;

wherein a threshold of released antimicrobial is no greater than one part per million;

wherein the substantially non-leaching bacteriostatic antimicrobial reduces gram-negative bacteria by at least seventy-five percent over a period of time between tub drain down and electrical system activation; and wherein the substantially non-leaching bacteriostatic antimicrobial inhibits biofilm growth.

9. The apparatus of claim 8, further comprising a bacteria probe, wherein the bacteria probe is configured for insertion and installation in a watertight fashion into the inlet water pipe or the water outlet pipe, and wherein electronics in the bacteria probe are sealed against dampness.

10. The apparatus of claim 8, wherein the tub comprises a non-porous acrylic surface.

11. A fill and drain whirlpool bathtub, comprising:

a tub having hydro massage water jets; an inlet water pipe; a water outlet pipe; a plurality of wall fittings for water flow; an air volume control; an air pipe for air flow; and a water pump;

wherein the inlet water pipe and the air pipe are made of plastic;

wherein the inlet water pipe is canted downward at over a four-degree angle from the water pump to one of the plurality of wall fittings for water flow;

wherein the inlet pipe is adhesively secured to a separate elbow fitting to form a water tight seal between the inlet water pipe and the separate elbow fitting;

wherein the inlet water pipe, the water outlet pipe, at least one of the plurality of wall fittings for water flow, the air pipe, and the water pump are impregnated with 0.001 percent to fifteen percent by weight of a substantially non-leaching antibacterial antimicrobial comprised of metal;

wherein a threshold of released antimicrobial is no greater than 1 part per million;

wherein the substantially non-leaching antibacterial antimicrobial reduces gram-negative bacteria by at least 90% over a period of time between tub drain down and electrical system activation; and wherein the substantially non-leaching antibacterial antimicrobial inhibits biofilm growth.

12. The apparatus of claim 11, wherein the tub comprises a non-porous acrylic surface.

13. A fill and drain whirlpool bathtub, comprising:

a tub having hydro massage water jets; an inlet water pipe; a water outlet pipe; a plurality of wall fittings for water flow; an air volume control; an air pipe for air flow; and a water pump;

wherein the inlet water pipe and the air pipe are made of plastic;

wherein the inlet water pipe is canted downward at over a four-degree angle from the water pump to one of the plurality of wall fittings for water flow;

wherein the inlet water pipe is adhesively secured to a separate elbow to form a water tight seal between the inlet water pipe and the separate elbow;

wherein at least one of the plurality of wall fittings is configured to compensate for tub wall draft by allowing water to flow from the inlet water pipe or from the water outlet pipe and into the tub;

wherein the inlet water pipe, the water outlet pipe, at least one of the plurality of wall fittings for water flow, the air pipe, and the water pump are impregnated with 0.1 percent to five percent by weight of a substantially non-leaching bacteriostatic antimicrobial;

wherein a threshold of released antimicrobial is no greater than 1 part per million;

wherein the substantially non-leaching bacteriostatic antimicrobial reduces gram-negative bacteria by at least seventy-five percent over a period of time between tub drain down and electrical system activation; and wherein the substantially non-leaching bacteriostatic antimicrobial inhibits biofilm growth.

14. The apparatus of claim 13, wherein the tub, the inlet water pipe, the water outlet pipe, the plurality of wall fittings, the air volume control, the air pipe, and the water pump collectively retain less than 4 ounces of water after the tub is drained of water.

15. The apparatus of claim 13, wherein the tub comprises a non-porous acrylic surface.

* * * * *